US010966287B2

(12) United States Patent
Romanov et al.

(10) Patent No.: US 10,966,287 B2
(45) Date of Patent: Mar. 30, 2021

(54) HIGH-TEMPERATURE NANOCOMPOSITE EMITTING FILM, METHOD FOR FABRICATING THE SAME AND ITS APPLICATION

(71) Applicants: NovaIR, Inc., Tucson, AZ (US); Igor Romanov, Minsk (BY)

(72) Inventors: Igor Romanov, Minsk (BY); Aleksandr Kropachev, Tuscon, AZ (US); Terje Skotheim, Tucson, AZ (US)

( * ) Notice: Subject to any disclaimer, the term of this patent is extended or adjusted under 35 U.S.C. 154(b) by 0 days.

(21) Appl. No.: 14/783,071

(22) PCT Filed: Apr. 8, 2014

(86) PCT No.: PCT/US2014/033381
§ 371 (c)(1),
(2) Date: Nov. 24, 2015

(87) PCT Pub. No.: WO2014/168977
PCT Pub. Date: Oct. 16, 2014

(65) Prior Publication Data
US 2016/0249412 A1 Aug. 25, 2016

Related U.S. Application Data

(60) Provisional application No. 61/853,607, filed on Apr. 9, 2013.

(51) Int. Cl.
*H05B 3/14* (2006.01)
*H05B 3/22* (2006.01)

(52) U.S. Cl.
CPC ..... *H05B 3/14* (2013.01); *H05B 3/22* (2013.01); *H05B 2203/032* (2013.01); *H05B 2214/04* (2013.01)

(58) Field of Classification Search
CPC ..... H05B 3/14; H05B 3/22; H05B 2203/032; H05B 2214/04; Y10S 977/00;
(Continued)

(56) References Cited

U.S. PATENT DOCUMENTS 3,252,827 A * 5/1966 Rose ..... C04B 35/573 338/309
4,296,309 A * 10/1981 Shinmi ..... H01C 7/006 219/543

(Continued)

FOREIGN PATENT DOCUMENTS

RU 2160790 C2 12/2000

OTHER PUBLICATIONS

Govindarajan, S., et al., "Development of a Diffusion Barrier Layer for Siliconand Carbon in Molybdenum—a Physical Vapor Deposition Approach", Mar. 1999, Metallurgical and Materials Transactions A, vol. 30A, Introduction, Experimental Details, Results. (Year: 1999).*

(Continued)

*Primary Examiner* — Tu B Hoang
*Assistant Examiner* — Masahiko Muranami
(74) *Attorney, Agent, or Firm* — Lewis Roca Rothgerber Christie LLP

(57) ABSTRACT

An inventive thin-film radiative structure is provided that includes a thin nanocomposite radiative film deposited on a substrate, the thin-film including a mix of finely dispersed phases formed by elements Mo, Si, C, O in the following atomic percentage terms: Mo from 10 to 20%, Si from 15 to 30%, C from 15 to 60%, O from 0 to 20%, and one or a combination of elements Ti, Zr, Hf, Cr, Si, Al, and B in percentage terms of 0-30%. The thin-film radiative structure has an emissivity of more than 0.7 for wavelengths 2-20 μm at temperatures above 500° C., and a sheet resistance of (Continued)

*Microanalysis Report*
EDAX

| *Element* | *Wt %* | *At %* |
|---|---|---|
| C | 48.16 | 69.94 |
| O | 14.46 | 15.77 |
| Si | 17.07 | 10.60 |
| Mo | 20.31 | 03.69 |

40 between 10 and 150 Ohm/sq. The radiative film may be used as a thermoresistive element in thin-film infra-red thermal emitters and infra-red heaters, and in nondispersive infrared sensors (NDIR) and photo-acoustic gas sensors, and as the radiative element in IR signaling devices.

26 Claims, 4 Drawing Sheets

(58) Field of Classification Search
CPC .. Y10S 977/70; Y10S 977/902; Y10S 432/00; H01B 1/04
USPC ..... 392/407, 432, 433, 434, 438, 435, 439; 219/541, 209, 552, 553, 543, 544, 270, 219/267, 505, 548; 428/426, 457, 688, 428/704, 336, 325, 469, 472, 697, 698, 428/701, 702; 29/610.1, 611; 338/307, 338/308, 309, 314; 420/429, 578; 977/949, 954; 148/668, 113, 257, 281, 148/518, 688; 252/181.4, 181.6, 504, 252/506, 509, 516, 518.1, 519.31, 519.34, 252/519.51, 519.52, 519.54
See application file for complete search history.

(56) References Cited

U.S. PATENT DOCUMENTS 4,849,605 A * 7/1989 Nakamori ..... B41J 2/345 219/543
5,045,237 A * 9/1991 Washburn ..... C04B 35/565 219/270
5,085,804 A * 2/1992 Washburn ..... C04B 35/565 219/270
5,156,909 A * 10/1992 Henager, Jr. ..... C23C 14/0036 257/E23.122
5,340,531 A * 8/1994 Jayashankar ..... C04B 35/58092 419/10
5,420,399 A * 5/1995 Sekhar ..... C04B 35/651 219/553
5,569,427 A 10/1996 Semenova et al.
5,611,953 A * 3/1997 Sekhar ..... C04B 35/58092 219/553
6,008,479 A * 12/1999 Jiang ..... H01K 1/04 219/270
6,099,978 A * 8/2000 Sekhar ..... C04B 35/58092 219/541
6,200,691 B1 3/2001 Moore et al.
6,563,095 B1 * 5/2003 Sundberg ..... B22F 3/105 219/553
6,589,898 B1 7/2003 Gnesin et al.
2002/0027130 A1 * 3/2002 Miyata ..... H05B 3/143 219/444.1
2004/0075528 A1 * 4/2004 Carbin ..... H01C 17/003 338/307
2006/0003567 A1 * 1/2006 Yoon ..... C23C 16/30 438/604
2007/0001570 A1 * 1/2007 Nomura ..... H01L 51/5265 313/113
2008/0202575 A1 * 8/2008 Ren ..... H01L 35/16 136/201
2008/0217324 A1 * 9/2008 Abbott ..... C23C 4/06 219/538
2011/0042589 A1 * 2/2011 Norwood ..... C23C 14/00 250/493.1
2012/0037068 A1 * 2/2012 Su ..... C23C 16/4586 117/95
2012/0228502 A1 * 9/2012 Willis ..... G01J 3/108 250/338.1

OTHER PUBLICATIONS

International Search Report, PCT/US2014/033381 dated Sep. 30, 2014 (2 pages).
Govindarajan, S. et al., "Development of a Diffusion Barrier Layer for Silicon and Carbon in Molybdenum—a Physical Vapor Deposition", Metallurgical and Materials Transactions a, vol. 30A, Mar. 1999, pp. 799-806.

* cited by examiner

*Microanalysis Report*
EDAX

| *Element* | *Wt %* | *At %* |
|---|---|---|
| C | 48.16 | 69.94 |
| O | 14.46 | 15.77 |
| Si | 17.07 | 10.60 |
| Mo | 20.31 | 03.69 |

40

HIGH-TEMPERATURE NANOCOMPOSITE EMITTING FILM, METHOD FOR FABRICATING THE SAME AND ITS APPLICATION

RELATED APPLICATIONS

The present application is a national phase application of PCT application number PCT/US14/33381 with an international filing date of Apr. 8, 2014, which claims the priority benefit of US Provisional Application Ser. No. 61/853,607 filed Apr. 9, 2013; the contents of which are hereby incorporated by reference in their entirety.

FIELD OF THE INVENTION

The present invention in general relates to high-temperature resistant composites and methods of fabrication, and in particular to inorganic nanocomposite thin films capable of emitting thermal energy in the infrared wavelength region as a result of resistive heating.

BACKGROUND OF THE INVENTION

Micromachined thin film thermal infrared emitters (IRE) play an important role in the development of highly accurate chemical sensors, and serve as the principal infrared emitting elements in optical gas sensor systems. The application of the infrared (IR) emitting membrane as a pulsed light source in IR absorption gas sensors typically requires thin-film resistors with a sheet (surface) resistance in the range of $R_S$=10-150 Ohm/□ (Ohm/square) with an accuracy of not less than ±5%. Other applications include as the IR radiating element in IR signaling devices, typically referred to as IR beacons.

Industrial production of IRE involves the formation of microstructures on a silicon (Si) wafer, and typically several hundred devices are processed simultaneously. The nanocomposite emitting film is deposited with chemical vapor deposition (CVD) or physical vapor deposition (PVD) methods. The specific features of the thin film IRE structure and the method of fabrication impose additional restrictions on materials and method for fabricating the thin film resistor.

The basic criterion of material selection for usage as a thermoresistive medium in IRE is the emission of IR light energy radiated by the material when heated, which is determined as emission power. The radiation emitted per unit surface area is:

$$E=\varepsilon\cdot\sigma\cdot T^4 \quad (1)$$

where ε is the emissivity of the surface; $\sigma=5.67\cdot10^{-8}$ $[W\cdot m^{-2}\cdot K^{-4}]$ is the Stephan-Boltzmann constant; and T is the temperature of the surface in ° K. In practice, when producing high efficiency thin film infrared emitters the most attractive materials are those that have high-temperature stability to T=700-800° C. or higher and with emissivity close to 1.

Among inorganic compounds with the parameters of the equation (1), some compounds of refractory and group VIII metals Mo, W, Ti, etc. may be defined, e.g., silicides of molybdenum and tungsten ($MoSi_2$ and $WSi_2$) and silicon carbide (SiC). These materials show very high thermal stability when heating to temperatures in the range of 1700-2000° C. The data quoted by Pears in: Progress in International Research on Thermodynamic and Transport Properties (Ed. F. F. Masi and D. H. Tsai. N.Y., Academic Press, 1962, p. 588), demonstrate high values of emissivity ε for several of these materials. For example, for sintered powder of $MoSi_2$ the integrated value in the infra-red wavelength region is approximately 0.8. According to data provided by Olson O. H. and Morris J. in Handbook of Thermophysical Properties of Solid Materials (Ed. A. Goldsmith et al. N. Y., Pergamon Press, 1961 v. 3, p. 931) the emissivity for powdered SiC is approximately 0.85.

Refractory compounds such as boride metals possess emissivity ε, close to 1.0. In particular, borides $ZrB_2$, $HfB_2$ have matter emissivity that is equal to 0.89. The aforementioned emissivity data is provided by the Handbook of Refractory Compounds (Authors G. V. Samsonov, I. M. Vinitskii, Plenum, N.Y., 1980). Also according to this handbook, refractory metals such as boride have a high fusion temperature and accordingly, high durability at high temperatures, compared to silicon based compounds such as $MoSi_2$, SiC. Temperature fusion for $ZrB_2$ is 3000° C., and for $HfB_2$ is 3200° C. However, these borides are very fragile, and therefore limits the use of borides in a pure state. However, borides possess value as an additive to other refractory compounds and alloys.

The aforementioned data characteristics serve as a basis for several patents on high-temperature devices where silicides of molybdenum and tungsten or mixtures of both are used. These devices are: thermal resistors (G.B. Pat. No. 828123), resistive infrared heaters (U.S. Pat. No. 3,681,737), infrared emitters (U.S. Pat. No. 7,038,227). The resistive heaters made of silicon carbide SiC (G.B. Pat. No. 1,423,136) are also known. Furthermore, in Japanese patent JP10208854, a composite material $MoSi_2$—SiC as a material for a resistive heater is described. In U.S. Pat. Nos. 6,589,898 and 6,770,856 for manufacturing of infrared heaters, complex composite materials are used which contain a mixture of refractory and group VIII metals [(Mo, W) $5Si_2$ and/or (Mo, W) 5SiC] (15/85) %+SiC (2/85) %+(Mo, W) $Si_2$ (0.8/55) %. In patent GB943054 for manufacturing of a resistive tubular heater composite, $MoSi_2$ and SiC with additives borides of metals Zr, Hf, V, Nb, Ta, Cr, Mo are used.

All thermal devices listed in the aforementioned patents have been produced from a hot-pressed powdered mixture of initial materials. The products produced are bulk samples. Because of the large dimensions and weight these thermal devices cannot be used for manufacturing of resistive thin film infrared emitters, as the resistor must rest on a thin (approximately 1 micron thickness) freely suspended fragile membrane.

Methods of production for these coatings from the aforementioned materials have been further advanced in other industrial sectors which are distinct from thermal infrared emitters. These branches of industrial sectors include a) space and aviation science of materials, b) protective coatings on samples of group VIII and refractory metals, and c) integrated circuits. U.S. Pat. No. 5,569,427 describes thermal protection systems for aerospace and hypersonic aircrafts that is provided with a coating applied to a porous substrate, for example fibrous ceramic material. The coating includes $MoSi_2$, SiC, $Al_2O_3$, $SiO_2$, and an organic solvent mixture. The coating is applied in the form of liquid paste. The dried coating can resist heating to 1500° C., and has emissivity of not less than 0.8. However, this method of production cannot be used for emitter production, since the thickness of the layer is from 50 to 100 micron compared with the required membrane thickness of approximately 1 micron. In addition, the membrane cannot withstand the pressure of the paste. In the process of paste drying, the coating suffers from a compressive stress that may cause the shrinkage and distortion of the membrane. Furthermore, the surface of the dried coating becomes rough and results in breakage of the protective layers.

There are many patents in which high-temperature coatings are applied with a jet plasma method in vacuum or in an atmosphere, such as vacuum plasma spray (VPS). The VPS method provides flat metal and volume surfaces with considerable strengthening and corrosion protection. In patent EP1428900 A1, a deposited layer of SiC together with a metal boride, such as $ZrB_2$, $TiB_2$ and/or $HfB_2$ is used to provide the protective coating. The use of metal boride prevents the decomposition of silicon carbide during superheating of plasma sputtering, thereby preserving the useful qualities of silicon carbide.

Recently, the development of methods for fabricating films from refractory and group VIII metal silicides, for example $MoSi_2$, in integrated circuit technology has advanced rapidly. S. P. Murarka in "Silicides for VLSI Applications" (Academic Press, New York, 1993. p. 200) describes methods for producing such films including vacuum evaporation, magnetron sputtering, and CVD techniques. These methods are either co-depositing a metal (e.g., Mo) and silicon mixture in the desired composition from two separate sources followed by annealing at higher temperatures and synthesis of $MoSi_2$ film, or by magnetron sputtering from a cold-pressed vacuum-sintered composite $MoSi_2$ target.

As Murarka describes in his book, the methods mentioned above have been used for deposition of films of thickness 0.1-1 microns which are applied for integrated circuit (IC) production to operate at temperatures below 500° C. However, thin $MoSi_2$ films are not applicable for use in high-temperature emitting devices of the structure shown in FIG. 1. The factor constraining such application of these films is the so-called "$MoSi_2$ pest reaction", a phenomenon peculiar to this inorganic composition, resulting in disintegration of $MoSi_2$ into powdery products. The phenomenon of the "$MoSi_2$ pest reaction" is described, for example, by Chou T. C. and Nieh T. G. in the article "Pest disintegration of thin $MoSi_2$ films by oxidation at 500° C.", Journal of Materials Science 29 (1994), 2963-2967. Low-temperature heating of $MoSi_2$ films in air (up to 450-500° C.) starts the process of oxidation. As a result, powdery products are formed and they contain $MoO_3$ whiskers which destroy the film. The "$MoSi_2$ pest reaction" effect is less pronounced in bulk materials. If a bulk material is rapidly heated up to 1500° C., the $MoSi_2$ surface becomes passivated with a hard $SiO_2$ layer and the effect of the "$MoSi_2$ pest reaction" slows down. A $SiO_2$ layer formed on the surface of the thin $MoSi_2$ film during the surface heating in air is not stable because this layer is rather thick and porous. After prolonged heating, the $MoSi_2$ film is completely transformed into powdered $MoO_3$. Therefore, pure (impurities-free) thin $MoSi_2$ films are not applicable in high-temperature emitting devices.

In U.S. Pat. No. 6,200,691 in order to reduce the "$MoSi_2$ pest" effect in a sputtering target of $MoSi_2$, the impurity of silicon carbide, SiC, is added. Films are formed by vacuum magnetron plasma sputtering of the target $MoSi_2$+X SiC in an argon atmosphere. The films are deposited on metal products (Ta, Nb, etc.) to protect the metals from oxidation at high-temperature heating of these products. It is reported that a layer deposited in pure Argon is structurally (thermally) stable and chemically resistant at temperatures up to 1000° C., and with sputtering in the atmosphere of ($Ar+N_2$) gas mixture the layers are stable at 1260° C.

Furthermore, it is also known that some compositions of transitive and refractory metals, in particular silicides of molybdenum and silicon carbide, possess a high value of emissivity and thermal resistance for a bulk material. However, application of these materials in the form of pure (without additional impurity) thin films in infrared emitters presents difficulties. Films of $MoSi_2$ under high-temperature heating lose their resistance because of oxidation of the top layer. SiC resistivity is of great importance, but does not provide the possibility of the creation of thin-film IRE with a low value of sheet resistance for a heating element based on this material.

While the method of production of thin films of $MoSi_2$, SiC and their mixtures which can be applied to fabrication of thin-film IRE is known, where the method consists of magnetron ionic-plasma sputtering in a high vacuum in the proximity of an inert gas Ar of an initial bulk material. However, there is currently no data as to the technological parameters of this method, and in particular, the composition of a source substance, conditions of formation, and the composition of films with optimal emissivity and thermal stability properties. There is also no information about the parameters of this method, that are required for depositing thin resistive films in the range of resistance which is required for application to IRE in optical gas sensors. Thus, there exists a need for a method for depositing thin resistive films with high thermal stability in the range of resistance which is required for application of IRE in sensors, such as optical gas sensors, and as infrared emitters in IR signaling devices.

SUMMARY OF THE INVENTION

An inventive thin-film radiative structure is provided that includes: a thin nanocomposite radiative film deposited on a substrate, the thin-film including a mix of finely-dispersed phases formed by elements selected from the group consisting of: Mo, Si, C, O that exist in the following atomic percentage terms: Mo from 10 to 20%, Si from 15 to 30%, C from 15 to 60%, O from 0 to 20%, and one or a combination of elements selected from the group consisting of: Ti, Zr, Hf, Cr, Si, Al, and B in atomic percentage terms of 0-30%. The thin-film radiative structure has an emissivity of 0.7 or higher for wavelengths 2-20 μm at temperatures above 500° C., and a sheet resistance of between 10 and 150 Ohm/sq. The substrate is one of a low stress membrane, a membrane with low tensile or compressive stress, silicon nitride, and ceramic. In specific embodiments the thin nanocomposite radiative film has a thickness of 0.1-2.0 μm. Embodiments of the inventive thin nanocomposites radiative film may be used as a thermoresistive element in thin-film infra-red thermal emitters and infra-red heaters, and in nondispersive infrared sensors (NDIR) and photoacoustic gas sensors and the radiative element in IR signaling devices.

BRIEF DESCRIPTION OF THE DRAWINGS

The present invention is further detailed with respect to the following non-limiting specific embodiments of the present invention. The appended claims should not be construed as being limited to the specific devices so detailed.

DESCRIPTION OF THE INVENTION

Figure 1A:
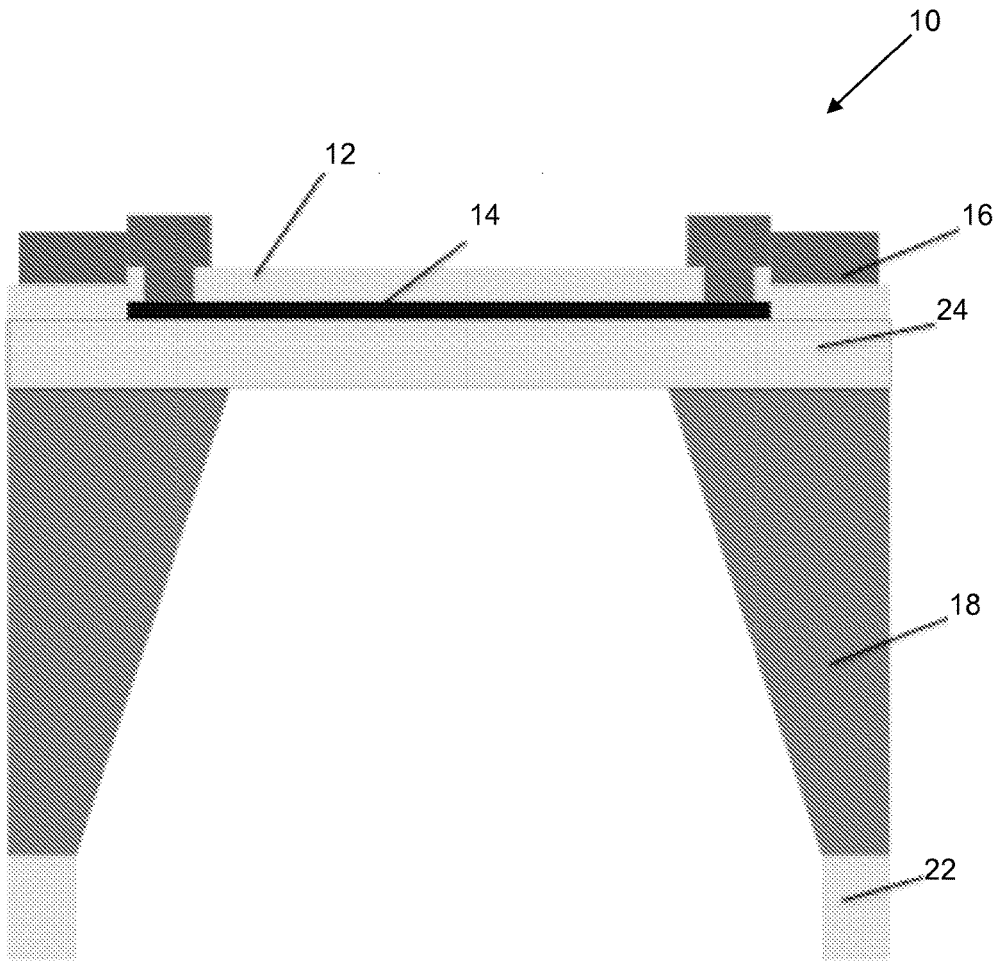
FIGS. 1A-1B are cross-sectional side and top views that depict the basic thin-film structure of an infrared emitter (IRE) chip.

The present invention has utility as a method for forming devices with inventive forms of inorganic nanocomposite thin films that are capable of emitting large amounts of thermal energy in the infrared wavelength region as a result of resistive heating. In certain embodiments, the fabrication of inventive thin films is by sputtering in a high vacuum of a mix of various refractory materials consisting of $MoSi_2$, SiC and/or oxides of various metals, e.g., Si, Ti, Zr, Al, B and/or boride metals, e.g., $TiB_2$, $ZrB_2$, $HfB_2$, $CrB_2$, $SiB_4$, $SiB_6$, $CB_2$ and/or carbide metals, e.g., TiC, ZrC, HfC.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

As used herein, high-temperature stability is defined as compositional retention to at least 500° C., and up to 900° C., and an emissivity of at least 0.7 for wavelengths 2-20 μm.

Unless otherwise stated herein, compositional percentages are provided in atomic percentages of a total composition for separate chemical elements and in molecular percent (mole %) for chemical compounds.

Embodiments of the present invention relate to a new class of nanocomposite materials suitable as thermoresistive material in Miro-Electro-Mechanical-Systems (MEMS) devices for infrared light emission and heating. The infrared emitting light sources can emit light in the range of 1-20 micrometers and can pulse up to 100 Hz and are suitable as light sources in IR gas sensors and infrared signalling devices. A suitable thickness of the nanocomposite thermoresistive film as an infrared light source is in the range 0.05-1.0 microns. The nanocomposite materials include a mixture of finely dispersed phases of materials formed of the chemical elements Mo, Si, C, O and Me, where Me is one of the metallic elements Ti, Zr, Al, B, or their combinations. Films of the nanocomposite material are produced using vacuum magnetron sputtering in an atmosphere of pure Ar from a target including $MoSi_2$+(10-85) mole % SiC+(0-30)% Y, where Y is selected from the metal-oxides $SiO_2$, $TiO_2$, $ZrO_2$, $Al_2O_3$, $B_2O_3$. Films can also be made by magnetron sputtering from a target including $MoSi_2$+(10-85 mole %) SiC in an atmosphere of a gas mixture consisting of Ar+$O_2$. The second variant of inventive films is produced by magnetron sputtering of target $MoSi_2$+(1-100) mole % SiC+(0-60) mole % Z where Z gets out of a number borides: $TiB_2$, $ZrB_2$, $HfB_2$, $CrB_2$, $SiB_4$, $SiB_6$, $CB_2$, or their combinations. The third variant of inventive films is produced by magnetron sputtering of target $MoSi_2$+(1-100) mole % SiC+(0-60) mole % W. Films have a total emissivity equal to 0.8 in the infrared spectrum at temperatures of 700° C. 800° C. The range of compositions as atomic percentage of the elements which include the nanocomposite films, as well as the range of weight percentage ratios of the components constituting the sputtering target are defined. Also defined is the range of pressure of oxygen at which the films have optimum value of sheet resistance in a range 10÷150 Ohm/□.

The novel thin-film infrared emitting materials form the active, emitting element in infrared light sources. The inventive infrared light sources have a multitude of applications, including, but not limited to nondispersive infrared sensor (NDIR) gas sensors.

Embodiments of the invention leverage known properties including:

The atomic percentage ratio of the elements which are a part thin nanocomposite films produced by sputtering in a vacuum of a bulk material in the form of a mixture of $MoSi_2$ and SiC have integral emissivity ε of approximately 0.8 in the infrared spectrum at a temperature of 700-800° C., and a sheet resistance $R_s$=10÷150 Ohm/□ (Ohm/square) with an accuracy of not less than ±5%.

The introduction in a structure of an initial mixture of metal oxides from the following: $SiO_2$, $TiO_2$, $ZrO_2$, $Al_2O_3$, $B_2O_3$ to the films improves the film's ability to stably operate as an IR emitter with a frequency range of up to 100 Hz.

The introduction in a structure of an initial mix of borides, refractory and other metals—$TiB_2$, $ZrB_2$, $HfB_2$, $CrB_2$, $SiB_4$, $SiB_6$, $CB_2$, where the introduction of these additives increases the lifetime performance of radiating and heating devices.

The introduction in a structure of an initial mix of carbides and refractory metals TiC, ZrC, HfC, where these additives increases lifetime performance of radiating and heating devices. These properties are achieved with vacuum magnetron sputtering of source materials in inert gas of Ar, or a gas mixture of Ar and $O_2$.

The inventive thin-films have a high total emissivity ε of typically 0.8 in the infra-red region of the spectrum, as measured with the thin-films deposited on a ceramic substrate. The same ceramic substrate covered with soot was used as a comparison, where the emissivity ε was considered equal to 1. The long term high thermal stability of the thin-films has been experimentally confirmed up to at least 900° C.

The inventive thin-films possess such high values of emissivity ε only for certain compositions of the initial sputtering target. If the composition of the initial sputtering target materials is represented by the formula ($MoSi_2$+X.SiC+Y), then X=mole percentage SiC, Y=mole percentage of metal-oxides from the group Si, Ti, Zr, Al, B or their mixture. The composition will be the following: 85>X (mole %)>10, 30>Y (mole %)>0. If X>85 mole %, the films have sheet resistance $R_s$>150 Ohm/□. The $R_s$ of the films increases with increased quantity of SiC. Application of such high-resistivity films in thin-film IRE is undesireable since the films will require a high voltage to operate. A similar effect of an undesirable increase in $R_s$ is observed with an increase in the components Y to more than 30 mole %. For X<10 mole %, a decrease in the hardness of the films at high-temperature is observed. This effect is connected with oxidation of the $MoSi_2$ phase with a low content of the phase SiC, whose presence slows down this negative process.

Figure 1B:
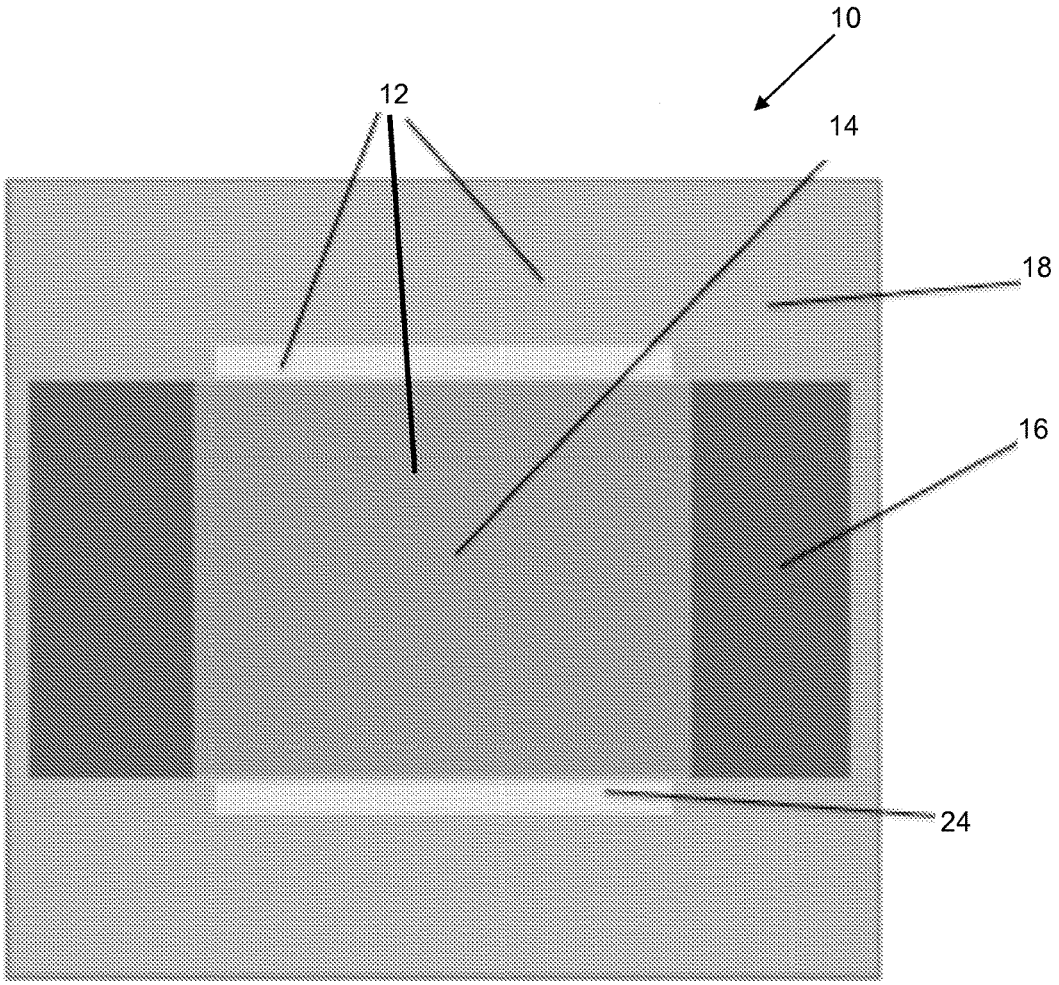

The present invention has utility as a thin-film resistor in thin membrane infra-red emitters (IRE). Such devices are made in the form of thin-film structures. The typical thin-film structure is shown in FIGS. 1A and 1B as used from example as an infrared emitter (IRE).

The basic element of the IRE structure 10 is a thin thermoresisitve film 14 of typical thickness of 0.05-0.4 μm (micro-meters (microns)) that is deposited on top of a thin low stress (typically 50-150 MPa) insulating (dielectric) membrane 24 with a typical thickness of 0.5-1.5 microns. The thin film structure of the infrared emitter 10 is characterized by the following combination of properties: a thin (typically 1.5-2.5 μm) free-hanging multilayer membrane supported by a silicon frame 18 (typically 0.4-0.5 mm thickness); and a thin low-stress (typically 50-150 MPa) dielectric membrane that is used as a substrate 24 for the thermoresistive film 14. The low thermal mass of the membrane coupled with high emissivity, allows the membrane to cycle in temperature with a frequency of 10-50 Hz, and up to 100 Hz.

The membrane or substrate 24 is formed with low-stress, non-stoichiometric silicon nitride (SiN), and includes in some inventive embodiments multilayers or alternating films comprising SiO2, SiN and nanoamorphous carbon that have a typical thickness of individual layers of 0.05-1.0 microns, for a typical combined thickness of 0.5-1.5 microns, if such multilayers are present. This multilayer membrane typically includes a protective topcoat 12 of a dielectric material, typically low-stress SiN, and includes in some inventive embodiments multilayers or alternating films comprising SiN, SiO2 and nanoamorphous carbon, with a typical total topcoat thickness of 0.1-1.0 microns as protection of the thermoresistive film 14 against oxidation. The multilayer membrane is suspended by a silicon frame 18 and produced with microsystems or MEMS (Micro-Electro-Mechanical-Systems) technology by etching the Si from the back of a Si wafer. The silicon wafer is coated on the backside by a film of SiN 22. Reactive Ion Etching (RIE) process was used to open windows in the backside SiN for etching the Si wafer from the backside in order to produce the freehanging multilayer membrane. The thin film thermoresistor 14 may be patterned in such a manner as to have a gap 15 between the thermoresistor and the silicon frame 18 along the edges in order to minimize thermal loss by conduction to the silicon frame 18 as shown in FIG. 1*b*. The gap 15, which consists of the dielectric support membrane 24 and the topcoat 12 may be 0-400 microns, and is typically 50-300 microns. The thin film thermoresistor 14 in some embodiments has a sheet resistance in the range of $R_s$=10-150 Ohm/□. The thin film thermoresistor 14 is positioned between metal contact pads 16. The method of fabrication of such thin membrane infra-red emitters (IRE) structures is compatible with standard microelectronic methods of fabrication of thin film devices on a substrate with PVD and CVD methods of film deposition. Magnetron sputtering provides for the formation of thin-film structures as shown in FIGS. 1A and 1B without membrane destruction.

In specific embodiments, the sputtering of the films is carried out in an argon atmosphere. Thus, the vacuum is reduced to a pressure $10^{-3}$ Pa. The sputtering process is conducted with Ar gas introduced into the vacuum chamber to a pressure $P=8\cdot10^{-2}\div2\cdot10^{-1}$ Pa. The sheet resistance of films $R_s$ does not depend strongly on the pressure. For a film thickness of 0.5 microns, the films have values in the range of $R_s$~20-40 Ohm/□ all values P in this range.

Figure 2:
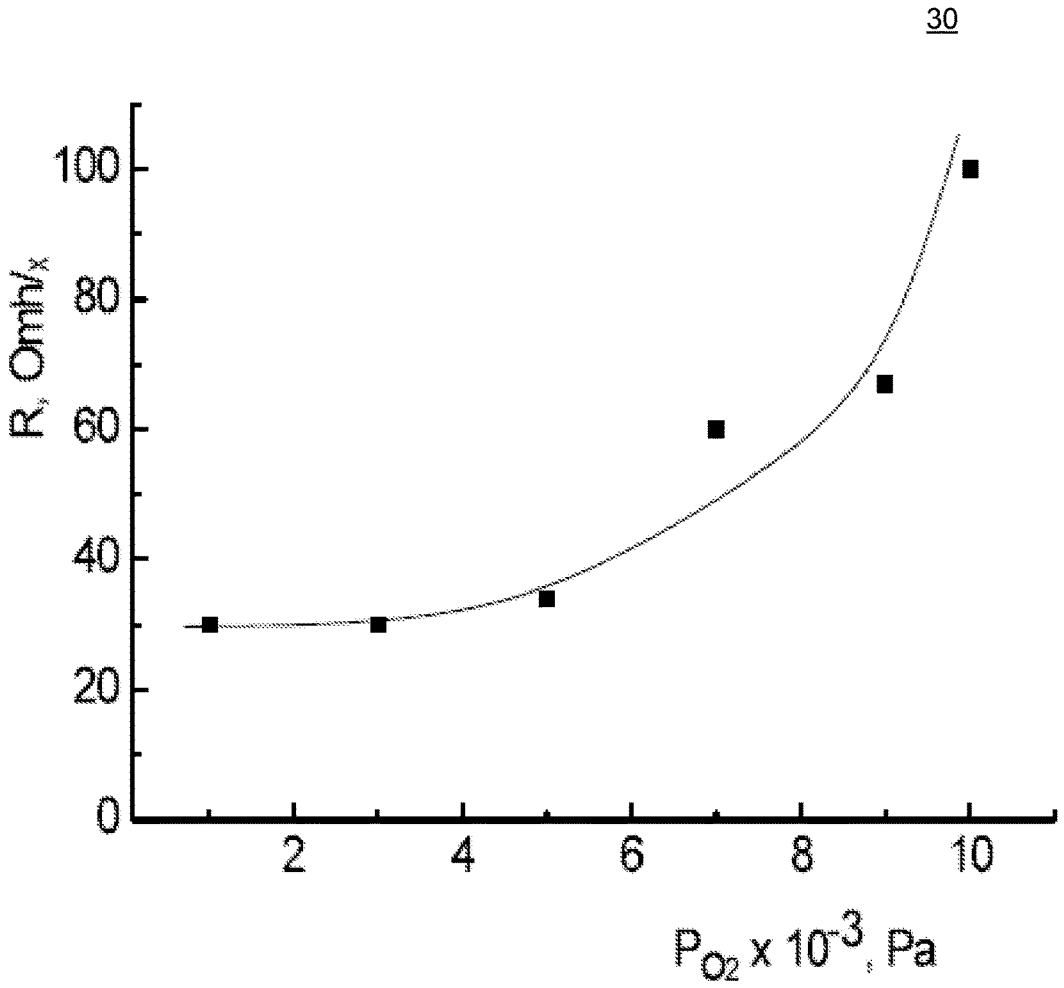
FIG. 2 is a graph of resistance as a function of background oxygen pressure inside a vacuum chamber for film deposition, and illustrates the dependence of sheet resistance of the films received by sputtering of a target: $MoSi_2$+35 mole % SiC in a partial pressure of oxygen $P_{oxygen}$.

It has surprisingly been discovered that if the sputtering is done in a mixture of argon and oxygen, the sheet resistance of the applied thin-film increases, and the thin-film resistance value depends on the partial pressure of oxygen. In FIG. 2, the dependence of sheet resistance of films produced from a target of $MoSi_2$+35 mole % SiC in a partial pressure of oxygen ($P_{oxygen}$) is shown. These tests are carried out for films of an identical thickness of 0.3 microns. For all experiments, the pressure of the gas mixture ($Ar+O_2$), is equal to $1\cdot10^{-1}$ Pa. As shown in FIG. 2, with a change in the partial pressure of oxygen in the range $P_{oxygen}=5\cdot10^{-3}$-$1\cdot10^{-2}$ Pa, the sheet resistance varies in the range $R_s$=30-100 Ohm/□. Furthermore, for the films deposited in a partial oxygen atmosphere, the emissivity and thermal stability are measured, and it is shown that these parameters do not deteriorate.

In inventive embodiments, the structure and phase composition of films are defined by the method of film deposition. At a thickness of 0.1-1 micron, the thin-films can be considered as quasi-two-dimensional objects and their properties are in many respects defined by properties of a surface of a substrate and the conditions of film growth. With ion-plasma methods of films deposition, and in particular magnetron sputtering, the target material is sputtered in a vacuum under the influence of high-energy ions of the inert gas (Ar) and deposited on a substrate in the form of a stream of neutral molecules, atoms, and ions. Condensation of this stream on a substrate at room temperature leads to formation of highly dispersed films with a complex multiphase composition and a quasi-amorphous structure. Furthermore, with the size of crystal grains in the nanometer range, the films are effectively a nanocomposite.

An analysis of the atomic-molecular structure of the thin-films described in the present invention was carried out. Electron transmission diffraction patterns of the films made immediately after deposition on a substrate exhibited the presence of two wide rings, characteristic of quasi-amorphous highly dispersed structures with crystal size of 2-5 nanometers. The type of rings and their characteristics demonstrated the presence of a considerable fraction of amorphous phases. Exact electron-diffraction analysis of phases with a size of crystal areas in the range 2-5 nanometers against an amorphous phase is difficult. The stream of a sputtered material contains ions and atoms and neutral molecules. Their condensation on a substrate can lead to formation of new phases.

Consider an example of a target having the following components: $MoSi_2$, SiC and $SiO_2$. If in a sputtered material the only phases present are α-$MoSi_2$ (tetragonal), β-SiC (cubic) and α-$SiO_2$(trigonal), the formation of other double and threefold phases, in particular, β-$MoSi_2$ (hexagonal), α-SiC (hexagonal), and $Mo_5Si_3$ (hexagonal), $Mo_2C$ (hexagonal), $Mo_{24}SiI_5C_3$, and also complex phases containing oxygen, for example, MoOC, $CSiO_2$, etc., is possible. Some of these phases can form solid solutions of a nonstoichiometric composition.

Figure 3:
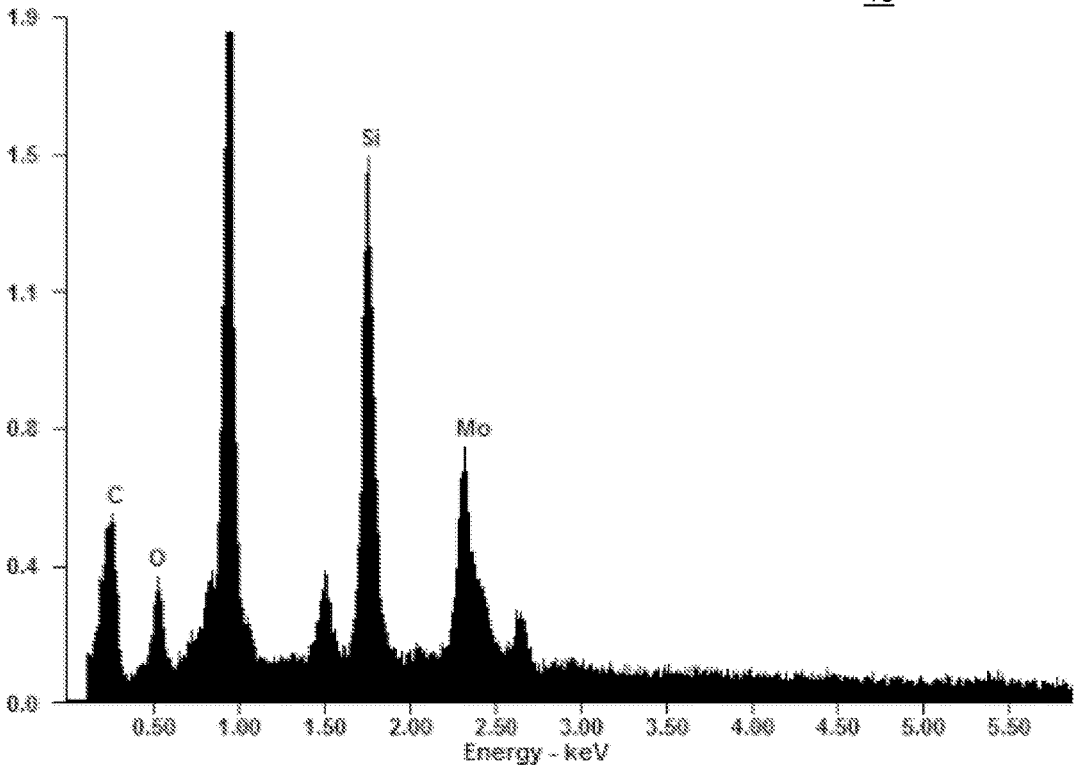
FIG. 3 is a graph of microanalysis results from an energy-dispersive X-ray spectroscopy (EDAX) of the films produced by sputtering of a target with a ($MoSi_2$+35 mole % SiC) composition.

By means of X-ray element analysis EDAX (Genesis 2000 system), the elemental composition and the atomic percentage ratios of elements of the films have been measured. FIG. 3 shows a typical X-ray spectrum measured for a film produced by sputtering of an initial material with composition ($MoSi_2$+35 mole % SiC) that is carried out in a mix of gases, such as Ar and $O_2$.

A determination of the dependence of emissivity and thermal stability of films on elemental composition is shown in Table 1 for the ranges of atomic percentages of the elements in the films studied, produced by target sputtering in pure Ar and in a mix of Ar and $O_2$. The films with such a ratio of elements in their composition have emissivity in the IR-region of the spectrum equal to approximately 0.8 and have a high thermal stability.

TABLE 1

| Gas filled into the chamber | At. % ratio of elements in film | | | |
|---|---|---|---|---|
| | Mo | Si | C | O |
| Ar | 5-25 | 10-35 | 30-85 | 0.5-1* |
| Ar + $O_2$ | 10-20 | 15-30 | 15-60 | 10-20 |

*attached foreign material

Embodiments of the inventive thin film in the form of a nanocomposite radiative film may be fabricated on a substrate while the substrate has an electrical bias applied, where the bias may be in the range of 0-400V. In addition the bias may be applied at a radio frequency (RF), where the RF ranges between 100 KHz-13.6 MHz.

Embodiments of the inventive nanocomposite radiative film may be thermal annealed at a temperature of between 800-950° C. in an atmosphere of air, argon, or a vacuum for a period of time of between 1-10 hours.

EXAMPLES

The following examples are intended to further illustrate the aspects of the invention.

Example 1

The target (a disk of diameter of 50 mm and thickness of 6 mm) was prepared by hot pressing and subsequent high-temperature annealing in a vacuum. The composition of the target (composition 1) is in mole %: $MoSi_2$—70; SiC—30. The substrate, a polished ceramic plate was placed in the vacuum chamber at a distance of 50 mm from the magnetron target. The vacuum chamber was pumped down to a pressure of $1\cdot10^{-3}$ Pa. Ar gas was filled in the chamber to a pressure of $1\cdot10^{-1}$ Pa. Sputtering was carried out with the following magnetron parameters: current—0.3 A; voltage—480V. The thickness of the film was 0.5 micron and the sheet resistance was 30 Ohm/□. The emissivity in the range 2-20 microns was 0.8.

Example 2

A target with the following composition in mole %: $MoSi_2$—25; SiC—75. The chamber is filled with Ar gas to a pressure of $1\cdot10^{-1}$ Pa. Sputtering is carried out with the following magnetron parameters: current—0.3 A; voltage—500V. The thickness of the film is 0.5 micron and the sheet resistance is 80 Ohm/□. The emissivity in the wavelength of 2-20 microns is 0.8.

Example 3

A target with the following composition in mole %: $MoSi_2$—34; SiC—46; $SiO_2$—20. The chamber is filled with Ar gas to a pressure of $1\cdot10^{-1}$ Pa. Sputtering is carried out with the following magnetron parameters: current—0.3 A; voltage—490V. The thickness of the film is 0.5 micron and sheet resistance 50 Ohm/□. The emissivity in the wavelength range of 2-20 micron is 0.79.

Example 4

A target with the following composition in mole %: $MoSi_2$—46; SiC—54. Oxygen is filled in the chamber to a pressure of $7\cdot10^{-3}$ Pa, and then Ar to a pressure of $1\cdot10^{-1}$ Pa. Sputtering is carried out with the following magnetron parameters: current—0.3 A; voltage—500V. The thickness of the film is 0.5 microns and sheet resistance 100 Ohm/□. The emissivity in the wavelength range 2-20 microns is 0.8.

Example 5

A target with the following composition in mole %: $MoSi_2$—33, SiC—53, $HfB_2$—14. The chamber is filled with Ar gas to a pressure of $1\cdot10^{-1}$ Pa. Sputtering is carried out with the following magnetron parameters: current—0.3 A, pressure—440. The thickness of the film is 0.5 micron and the sheet resistance is 60 Ohm/□. The emissivity in the wavelength of 2-20 microns is 0.8.

Example 6

A target with the following composition in mole %: $MoSi_2$—29, SiC—60, TiC—11. The chamber is filled with Ar gas to a pressure of $1.10^{-1}$ Pa. Sputtering is carried out with the following magnetron parameters: current—0.3 A, pressure—440. The thickness of the film is 0.4 micron and the sheet resistance is 70 Ohm/□. The emissivity in the wavelength of 2-20 microns is 0.8.

Any patents or publications mentioned in this specification are herein incorporated by reference to the same extent as if each individual publication was specifically and individually indicated to be incorporated by reference. The foregoing description is illustrative of particular embodiments of the invention, but is not meant to be a limitation upon the practice thereof.

The invention claimed is:

1. A thin-film radiative structure, comprising:

a substrate; and a radiative film deposited on and supported by the substrate, the radiative film comprising a mixture of at least first and second nanocrystals sputtered from an initial target comprising $MoSi_2$ and SiC;

the at least first and second nanocrystals being finely mixed and different from each other in phase or elemental composition, each having an average crystal grain size of 100 nm or smaller; and the elemental composition of each of the at least first and second nanocrystals independently comprising: Mo in an amount of 10 to 20 atomic %, Si in an amount of 15 to 30 atomic %, C in an amount of 15 to 60 atomic %, and O in an amount of 0 to 20 atomic %, and at least one element selected from the group consisting of: Ti, Zr, Hf, Cr, Al, and B in an amount of 0 to 30 atomic %.

2. The thin-film radiative structure of claim 1, wherein the at least first and second nanocrystals each have an average crystal grain size of 2 to 100 nm.

3. The thin-film radiative structure of claim 1, wherein the at least first and second nanocrystals each have an average crystal grain size of 2 to 10 nm.

4. The thin-film radiative structure of claim 1, wherein the radiative film has an emissivity of at least 0.7 for wavelengths 2 to 20 μm at a temperature above 500° C.

5. The thin-film radiative structure of claim 1, wherein the radiative film has a sheet resistance of 10 to 150 Ohm/sq.

6. The thin-film radiative structure of claim 1, wherein the substrate is a low stress membrane with stress in a range of 50 to 150 MPa.

7. The thin-film radiative structure of claim 1, wherein the substrate is a membrane with low tensile or compressive stress of 50 to 150 MPa.

8. The thin-film radiative structure of claim 1, wherein the substrate is made of silicon nitride.

9. The thin-film radiative structure of claim 1, wherein the substrate is a multilayer structure consisting of alternating layers of silicon nitride and silicon oxide.

10. The thin-film radiative structure of claim 9, wherein the silicon nitride and silicon oxide layers each have an individual thickness of 0.05 to 1.0 μm.

11. The thin-film radiative structure of claim 1, wherein the substrate is ceramic.

12. The thin-film radiative structure of claim 1, wherein the radiative film has a thickness of 0.05 to 1.0 μm.

13. An infra-red thermal emitter, comprising:

the thin-film radiative structure of claim 1; and an electric current source configured to heat the radiative film by passing an electric current through the radiative film.

14. An infra-red heater, comprising:

the thin-film radiative structure of claim 12; and an electric current source configured to heat the radiative film by passing an electric current through the radiative film.

15. A method of fabricating a thin film, the method comprising:

sputtering from an initial target comprising $MoSi_2$ and SiC under an atmosphere of argon (Ar) or Ar mixed with an oxygen ($O_2$) partial pressure of 0 Pa to $1\times10^{-2}$ Pa to thereby form a radiative film on a substrate, the SiC being included in the initial target in an amount of 10 to 85 mol %, with the remainder being $MoSi_2$;

the radiative film comprising a mixture of at least first and second nanocrystals;

the at least first and second nanocrystals being finely mixed and different from each other in phase or elemental composition, each having an average crystal grain size of 100 nm or smaller; and the elemental composition of each of the at least first and second nanocrystals independently comprising: Mo in an amount of 10 to 20 atomic %, Si in an amount of 15 to 30 atomic %, C in an amount of 15 to 60 atomic %, and O in an amount of 0 to 20 atomic %, and at least one element selected from the group consisting of: Ti, Zr, Hf, Cr, Al, and B in an amount of 0 to 30 atomic %.

16. The method of claim 15, wherein:

the initial target further comprises at least one of an oxide, a metal carbide, or a boride, the oxide being included in the initial target in an amount of 0 to 30 mol %, the metal carbide being included in the initial target in an amount of 0 to 60 mol %, and the boride being included in the initial target in an amount of 0 to 60 mol %.

17. The method of claim 16, wherein the oxide is selected from the group consisting of $SiO_2$, $TiO_2$, $ZrO_2$, $Al_2O_3$, $B_2O_3$, and combinations thereof.

18. The method of claim 16, wherein the boride is selected from the group consisting of $TiB_2$, $ZrB_2$, $HfB_2$, $CrB_2$, $SiB_4$, $SiB_6$, $CB_2$, and combinations thereof.

19. The method of claim 16, wherein the metal carbide is selected from the group consisting of TiC, HfC, ZrC, and combinations thereof.

20. The method of claim 15, further comprising applying an electrical bias to the substrate, the electrical bias being 0 to 400 V.

21. The method of claim 20, wherein the electrical bias is applied at a radio frequency of 100 KHz to 13.6 MHz.

22. The method of claim 15, further comprising thermally annealing the radiative film on the substrate at a temperature of 800 to 950° C. under an air, argon, or vacuum atmosphere.

23. The method of claim 22, wherein the thermal annealing is performed for 1 to 10 hours.

24. The thin-film radiative structure of claim 1, wherein the initial target further comprises one or more of $SiO_2$, $TiO_2$, $ZrO_2$, $Al_2O_3$, $B_2O_3$, $TiB_2$, $ZrB_2$, $HfB_2$, $CrB_2$, $SiB_4$, $SiB_6$, $CB_2$, TiC, ZrC, and/or HfC.

25. A device, comprising the thin-film radiative structure of claim 1 configured as a thermo-resistor that is heatable by an electric current.

26. The device according to claim 25, wherein the device comprises a nondispersive infrared sensor (NDIR), a photoacoustic gas sensor, or an infrared signaling device.

* * * * *